US006798439B2

(12) United States Patent
Rudi

(10) Patent No.: US 6,798,439 B2
(45) Date of Patent: Sep. 28, 2004

(54) THERMAL RECORDING BY MEANS OF A FLYING SPOT

(75) Inventor: Vanhooydonck Rudi, Zwijndrecht (BE)

(73) Assignee: Agfa-Gevaert (BE)

( * ) Notice: Subject to any disclaimer, the term of this patent is extended or adjusted under 35 U.S.C. 154(b) by 30 days.

(21) Appl. No.: 10/242,034

(22) Filed: Sep. 12, 2002

(65) Prior Publication Data

US 2003/0067796 A1 Apr. 10, 2003

Related U.S. Application Data

(60) Provisional application No. 60/334,630, filed on Oct. 25, 2001.

(30) Foreign Application Priority Data

Oct. 2, 2001 (EP) ..... 01000515

(51) Int. Cl.[7] ..... B41J 2/47
(52) U.S. Cl. ..... 347/240; 347/251
(58) Field of Search ..... 347/237, 240, 347/247, 251, 183, 188

(56) References Cited

U.S. PATENT DOCUMENTS

| | | | | |
|---|---|---|---|---|
| 5,066,962 A | | 11/1991 | Sarraf | |
| 5,278,578 A | * | 1/1994 | Baek et al. | 347/240 |
| 5,804,355 A | | 9/1998 | Bosschaerts et al. | |
| 5,932,394 A | | 8/1999 | Van Hunsel et al. | |
| 5,990,917 A | * | 11/1999 | Wendt | 347/187 |

FOREIGN PATENT DOCUMENTS

| | | |
|---|---|---|
| EP | 0 485 148 A2 | 5/1992 |
| EP | 0 842 782 A2 | 5/1998 |
| EP | 0 978 760 A1 | 2/2000 |
| EP | 1 104 699 A1 | 6/2001 |
| JP | 62077983 | 4/1987 |

OTHER PUBLICATIONS

European Search Report for 01 00 0515 (Mar. 15, 2002).

* cited by examiner

*Primary Examiner*—Huan Tran
(74) *Attorney, Agent, or Firm*—Leydig, Voit & Mayer, Ltd

(57) ABSTRACT

An apparatus for thermal recording an image in a substantially light-insensitive thermographic material m having a burning temperature $T_b$, the substantially light-insensitive thermographic material m comprising a thermosensitive element having a conversion temperature $T_c$, a support, and at least one light-to-heat conversion agent, comprises a means for generating a radiation beam 20 including wavelengths λ absorbed by the light-to-heat conversion agent and an optical means of scanning a line 40 of the substantially light-insensitive thermographic material m with the radiation beam 20 at different positions thereon along a scanning direction at each point of time in a scanning cycle; and a method for recording information, comprising the steps of: providing an apparatus for thermal recording 1, the above-mentioned substantially light-insensitive thermographic material m (5); generating a radiation beam 20 including wavelengths λ absorbed by the light-to-heat conversion agent and being modulated in accordance with the information to be recorded; scanning a line 40 of the substantially light-insensitive thermographic material m a first time with the radiation beam, thereby heating the line of the substantially light-insensitive thermographic material m to a first predetermined temperature $T_1$ being above the conversion temperature $T_c$ and below the burning temperature $T_b$ of the substantially light-insensitive thermographic material m; re-scanning the same line of the substantially light-insensitive thermographic material m a plurality of times $n_s$ with the radiation beam being identically modulated in accordance with the information to be recorded.

12 Claims, 8 Drawing Sheets

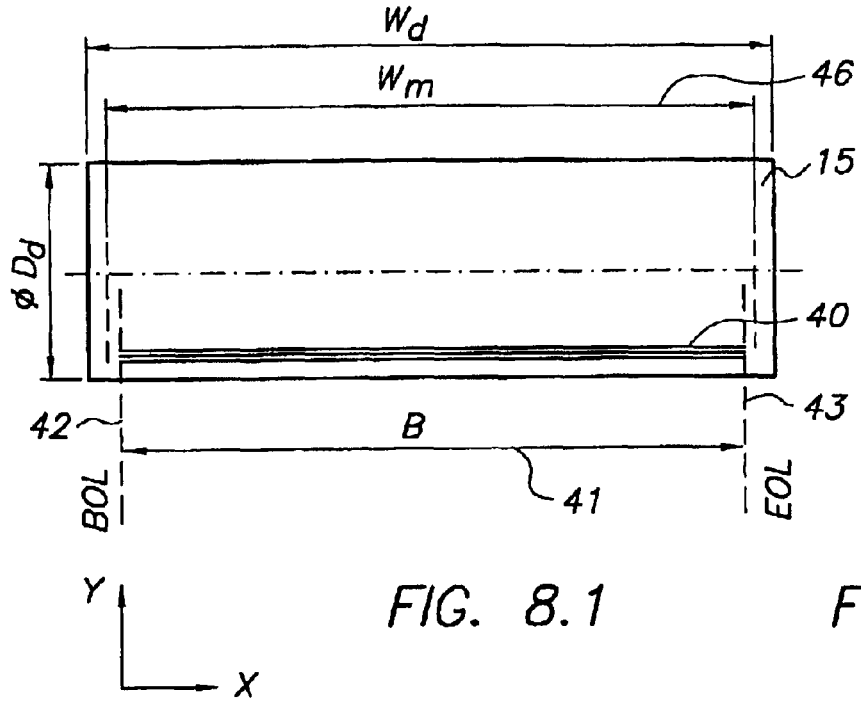
FIG. 8.1
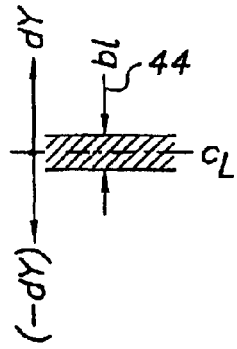
FIG. 8.2
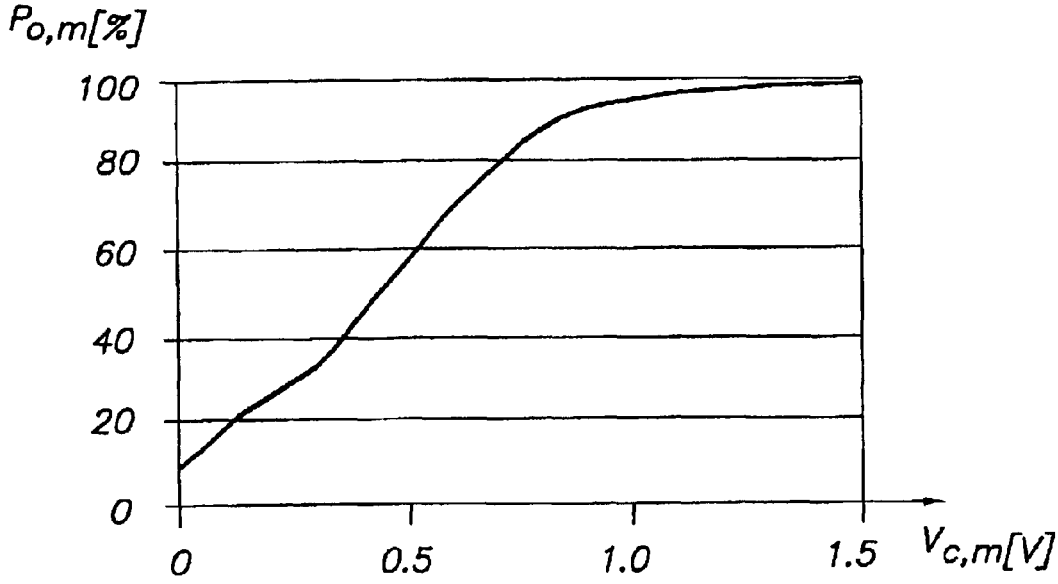
FIG. 9

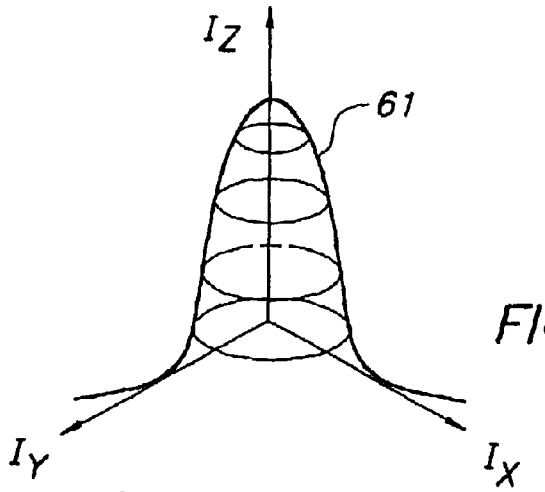
FIG. 13
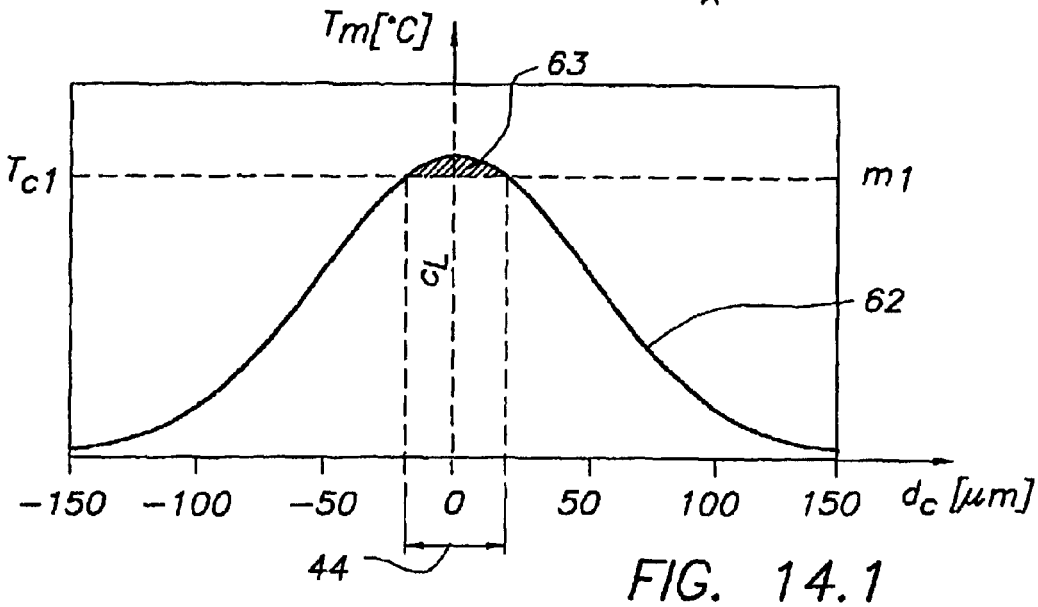
FIG. 14.1
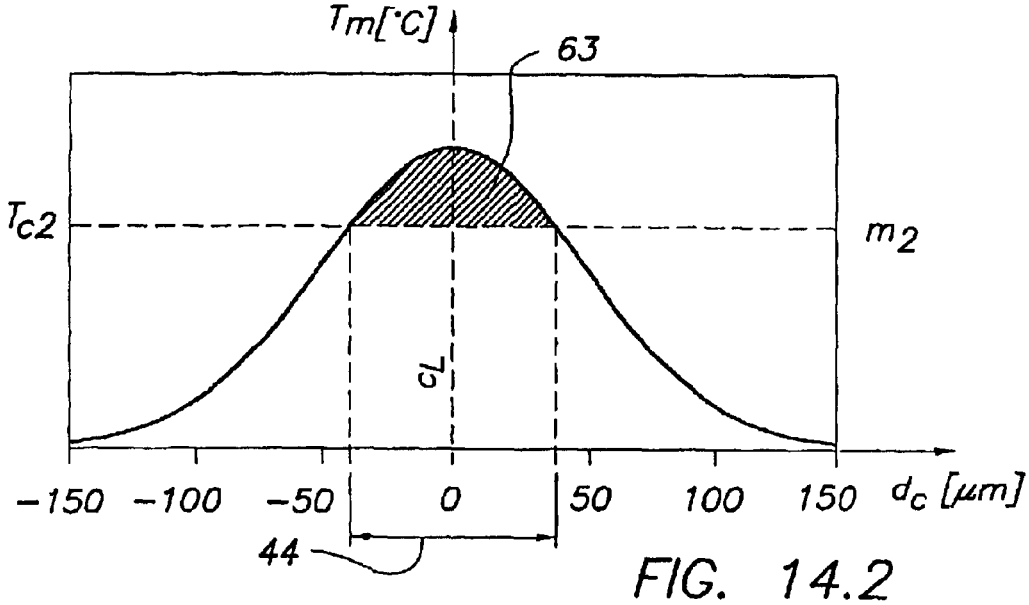
FIG. 14.2

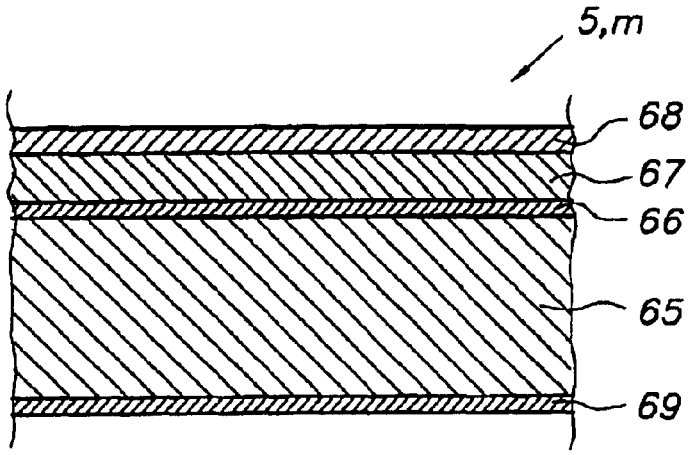
FIG. 17
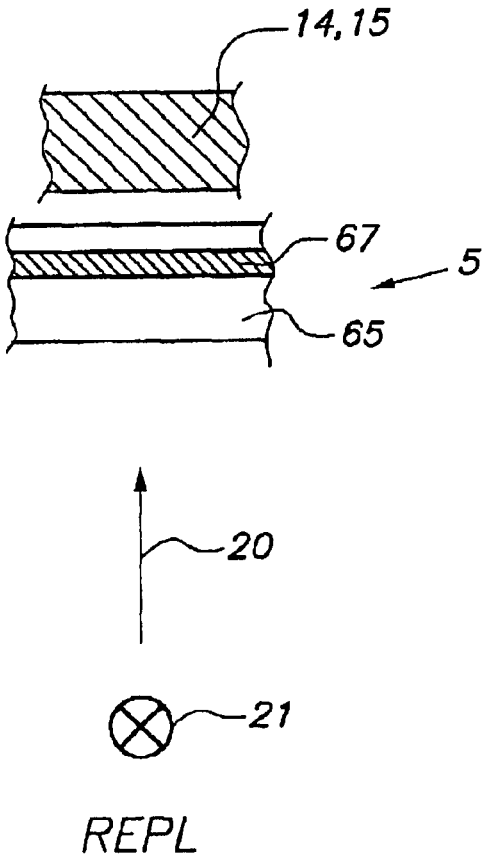
FIG. 18.1
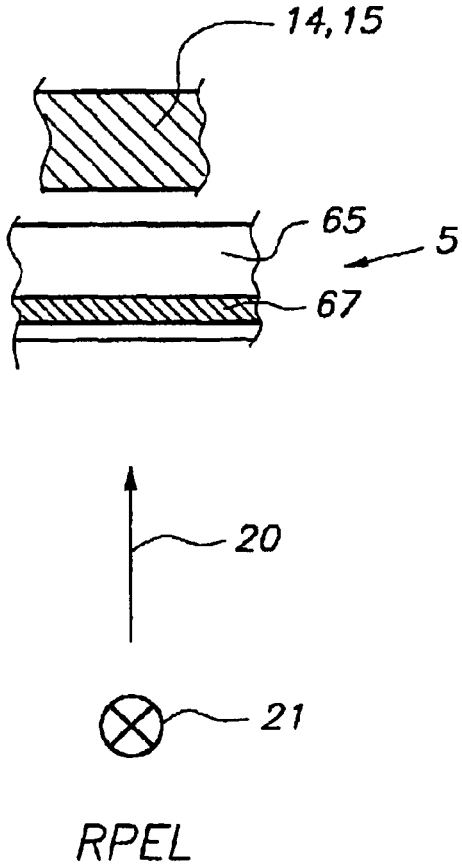
FIG. 18.2

THERMAL RECORDING BY MEANS OF A FLYING SPOT

The application claims the benefit of U.S. Provisional Application No. 60/334,630 filed Oct. 25, 2001, which is herein incorporated by reference.

FIELD OF THE INVENTION

The present invention relates to a method and an apparatus for thermal recording by means of a flying spot.

BACKGROUND OF THE INVENTION

Thermal imaging or thermography is a recording process wherein images are generated by the use of imagewise modulated thermal energy. Most of the direct thermographic recording materials are of the chemical type. On heating to a certain conversion temperature, an irreversible chemical reaction takes place and a coloured image is produced. A particular interesting direct thermal imaging element uses an organic silver salt in combination with a reducing agent. Such combination may be imaged by a suitable heat source such as e.g. a thermal head, a laser etc.

A black and white image can be obtained with such a material because under the influence of heat the silver ions are developed to metallic silver. However, it appears to be difficult to obtain a neutral black tone image. Furthermore, it appears to be difficult to obtain a sufficiently high density as required in certain applications (e.g. in graphical applications).

Thermal recording information on a thermographic material by means of so-called "flying spot scanning" is well-known from the prior art.

The thermal recording can be carried out with the aid of different types of recording devices, e.g. a flat bed type recording (see FIG. 1), a capstan type recording device (see FIG. 2), an internal drum type ITD recording device (see FIG. 3) or an external drum type XTD recording device (see FIGS. 4, 5 and 6). An extensive description of such recording devices can be found e.g. in EP 0 734 148 and in U.S. Pat. No. 5,932,394 (both in the name of Agfa-Gevaert), so that in the present description any explicit and extensive replication is superfluous.

EP-A 0 485 148 discloses an image recording apparatus for recording an image by application of light beam to a photosensitive member, comprising: a photosensitive member; light source means for emitting first and second beams, one of the first and second beams bearing image information; and scanning means for scanning said photosensitive member with the first and second beams with a time interval so that they are overlapped on said photosensitive material.

EP-A 0 842 782 discloses a method of thermally recording a gradation image on a thermosensitive recording material (S) having a photothermal converting agent for converting light energy into thermal energy to develop a color at a density depending on the thermal energy, comprising the steps of: applying a laser beam (L) having a level of light energy depending on a gradation of an image to be recorded on the thermosensitive recording medium (S); and scanning the thermosensitive recording medium (S) with the laser beam (L) at a speed of at least 5 m/s.

EP-A 1 104 699 discloses a method for recording an image on a thermographic material (m) comprising the steps of: providing a thermographic material having a thermal imaging element (le), a transparent thermal head (TH) having energisable heating elements (Hi), and a radiation beam (L), activating heating elements of said thermal head and imagewise and scanwise exposing said imaging element by means of said radiation beam, such that the total energy resulting from said thermal head and from said radiation beam has a level corresponding to a gradation of the image to be recorded on said imaging element, wherein said imagewise and scanwise exposing is carried out by passing said radiation beam through transparent parts of said thermal head.

U.S. Pat. No. 5,932,394 discloses a method for generating on a lithographic printing plate a screened reproduction of a contone image, comprising the steps of: (1) transporting a thermosensitive imaging element through an exposure area, the imaging element having thereon at least one scan line including a plurality of microdots, at least one microdot being an effective microdot; (2) scanwise exposing said thermosensitive imaging element according to screened data representative for tones of a contone image with a set of radiation beams as said thermosensitive imaging element is transported through said exposure area, at least one of said radiation beams being an effective radiation beam, at any given moment during said exposure at least two radiation beams of said set of radiation beam impinge on different microdots of a scanline on said imaging element, so that by completion of the exposure step each effective microdot of said scanline has been impinged by all effective beams of said set, wherein said thermosensitive imaging element includes an image forming layer on a hydrophilic surface of a lithographic base, said image forming layer comprising hydrophobic thermoplastic polymer particles and a compound capable of converting light into heat, said compound being present in one of said image forming layer and a layer adjacent thereto.

Thermal recording according to the prior art by means of a flying spot laser on a thermographic material generally only gives a sufficient density if the energy radiated by the laser beam is so high that unwanted side-effects occur (e.g. burning, shrinkage and irregular expansion). If one diminishes the energy in order to eliminate such side effects, the output density is unacceptably low.

This problem in particular applies to graphical applications often requiring optical densities greater than 3.0 or 4.0 or even 5.0 D. In addition, high spatial resolutions as e.g. higher than 600 or even 1200 dpi are often required or small line-widths e.g. smaller than 40 or even 20 $\mu$m or fine pixel-sizes e.g. finer than 40 or even 20 $\mu$m.

ASPECTS OF THE INVENTION

It is an aspect of the present invention to provide an apparatus for thermal recording which is capable of yielding images with improved tone neutrality.

It is a further aspect of the present information to provide a method for recording information, which is capable of yielding images with improved tone neutrality.

Further aspects and advantages of the invention will become apparent from the description hereinafter.

SUMMARY OF THE INVENTION

Aspects of the present invention are realized by an apparatus for thermal recording an image in a substantially light-insensitive thermographic material m having a burning temperature $T_b$, the substantially light-insensitive thermographic material m comprising a thermosensitive element having a conversion temperature $T_c$ a support, and at least one light-to-heat conversion agent, comprises a means for generating a radiation beam 20 including wavelengths λ absorbed by the light-to-heat conversion agent and an optical means of scanning a line 40 of the substantially light-insensitive thermographic material m with the radiation beam 20 at different positions thereon along a scanning direction at each point of time in a scanning cycle.

Aspects of the present invention are also realized by a method for recording information, comprising the steps of: providing an apparatus for thermal recording 1, the above-mentioned substantially light-insensitive thermographic material m (5); generating a radiation beam 20 including wavelengths λ absorbed by the light-to-heat conversion agent and being modulated in accordance with the information to be recorded; scanning a line 40 of the substantially light-insensitive thermographic material m a first time with the radiation beam, thereby heating the line of the substantially light-insensitive thermographic material m to a first predetermined temperature $T_1$ being above the conversion temperature $T_c$ and below the burning temperature $T_b$ of the substantially light-insensitive thermographic material m; re-scanning the same line of the substantially light-insensitive thermographic material m a plurality of times $n_s$ with the same radiation beam being identically modulated in accordance with the information to be recorded.

Aspects of the present invention are also realized by the use of the above-mentioned method in laser thermography.

Further advantages and embodiments of the present invention will become apparent from the following description and drawings.

DETAILED DESCRIPTION OF THE INVENTION

BRIEF DESCRIPTION OF THE DRAWINGS

FIG. 8.1 shows three consecutive scanning lines on a thermographic material passing an external drum.

FIG. 8.2 shows an enlarged detail of a printed line have a line-width $b_1$.

FIG. 9 shows a relation between a control voltage to an acousto-optical modulator and the percentage of transmitted laser power.

FIG. 13 shows a three-dimensional distribution of the available intensity (or power) of a Gaussian laser beam.

FIG. 14.1 shows the geometrical spread of the temperature $T_m$ reached in a thermographic material when scanned according to a preferred embodiment of the invention.

FIG. 14.2 shows the geometrical spread of the temperature $T_m$ reached in a substantially light-insensitive thermographic material when scanned according to another preferred embodiment of the invention.

FIG. 17 shows the configuration of a substantially light-insensitive thermographic material suitable for application within the present invention.

FIGS. 18.1 and 18.2 respectively shows a thermographic system incorporating a first and a second position of the thermosensitive element with respect to a holding means.

Figure 1:
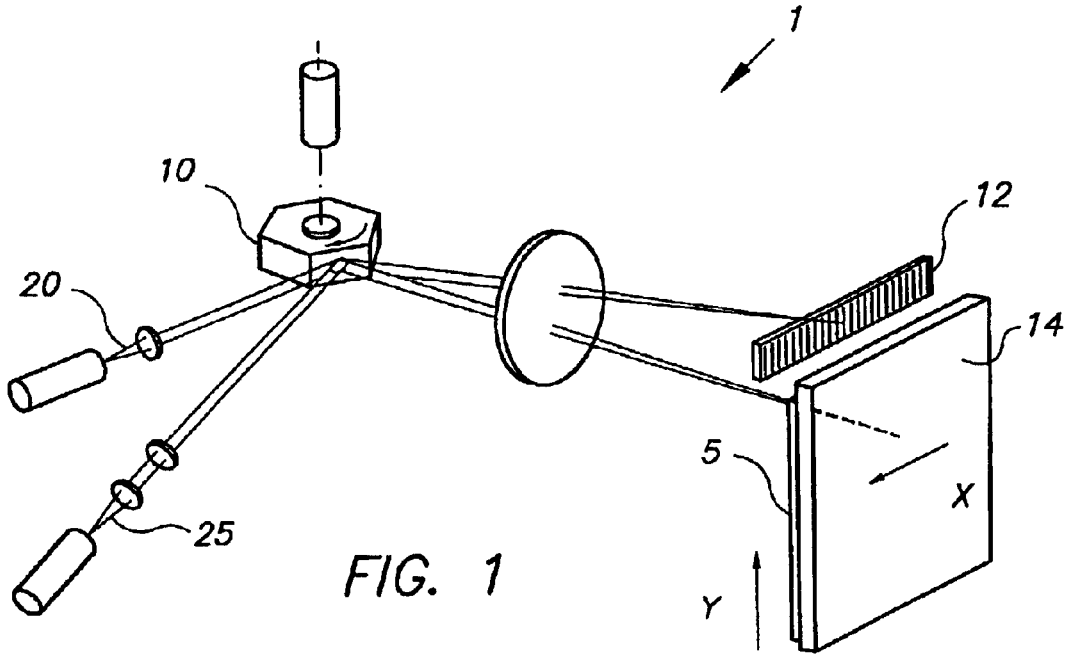
FIG. 1 schematically shows a flat bed type recording device suitable for use in a method according to the present invention.
Figure 2:
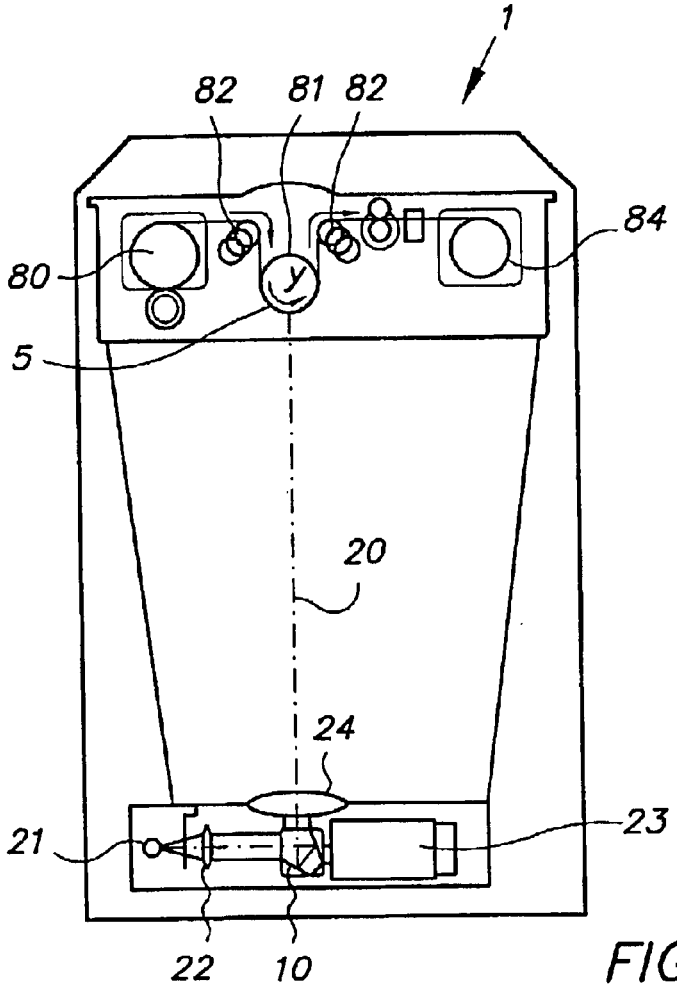
FIG. 2 shows a capstan type recording device suitable for use in a method according to the present invention.
Figure 3:
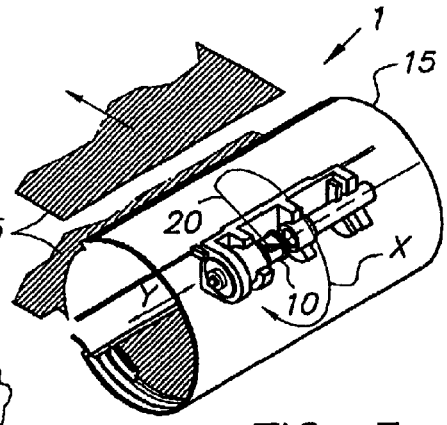
FIG. 3 schematically shows an internal drum type recording device suitable for use in a method according to the present invention.

| Parts list | |
|---|---|
| 1 | thermal printing system |
| 5 | substantially light-insensitive thermographic material m |
| 10 | moving mirror (e.g. polygon) |
| 12 | radiation detecting element |
| 14 | holding means (e.g. flat) |
| 15 | drum |
| 17 | hardcopy print |
| 18 | drive system for drum |
| 19 | laser-diode-array |
| 20 | writing radiation beam |
| 21 | radiation source |
| 22 | filter |
| 23 | spin motor |
| 24 | lens |
| 25 | reference radiation beam |
| 26 | first mirror |
| 27 | second mirror |
| 28 | modulator |
| 29 | concave lens |
| 31 | control of drum (temperature, speed) |
| 32 | power supply (polygon, modulator) |
| 33 | speed control of polygon |
| 34 | control of radiation source (incl. cooling) |
| 35 | control of video signal |
| 40 | line |
| 41 | line-length B |
| 42 | BOL |
| 43 | EOL |
| 44 | line-width $b_1$ |
| 46 | material width $W_m$ |
| 50 | temperature evolution over time |
| 51 | heating curve |
| 52 | cooling curve |
| 55 | ambient temperature $T_a$ |
| 56 | temperature $T_2$ |
| 57 | conversion temperature $T_c$ |
| 58 | temperature $T_1$ |
| 59 | burning temperature $T_b$ |
| 61 | three-dimensional distribution of a Gaussian beam-intensity |
| 62 | two-dimensional distribution of temperature $T_{m1}$ |
| 63 | two-dimensional distribution of temperature $T_{m2}$ |
| 65 | support |

-continued

| Parts list | |
|---|---|
| 66 | substrate |
| 67 | thermosensitive element |
| 68 | protective layer |
| 69 | backing layer |
| 80 | supply magazine |
| 81 | capstan |
| 82 | tension roller |
| 84 | take-up system |
| 102 | supply magazine |
| 104 | belt |
| 105 | tension roller |
| 107 | sheet of thermographic material |
| 108 | roller |
| 109 | roller |
| 110 | controller |
| 113 | ventilator |
| 116 | sheet exit |
| 117 | keyboard |
| 118 | laser source |
| 119 | modulator |
| 120 | first objective |
| 121 | polygon mirror |
| 122 | second objective |
| 123 | sheet input |
| 124 | sheet feeder |
| 125 | imaging and processing unit/recording unit |
| X | fast-scan-direction |
| Y | slow-scan-direction |

Terms and Definitions

By the term "laser thermography" is meant an art of direct thermography comprising a uniform preheating step not by any laser and an imagewise exposing step by means of a laser (see e.g. EP-A 1 104 699).

The term "thermography" for the purposes of the present application is concerned with materials which are not directly photosensitive, but are sensitive to heat or thermosensitive and wherein a visible change in a thermosensitive imaging material is brought about by the application of sufficient imagewise applied heat to bring about a change in optical density. This image-wise applied heat can be applied by a heat source in the direct vicinity of the thermosensitive material or it can be realized in the thermosensitive material as a result of the absorption of imagewise applied light by the presence in the thermosensitive material of at least one light-to-heat conversion agent.

The term "thermographic material" (or more completely worded as a 'thermographic recording material', hereinafter indicated by symbol m) comprises a thermosensitive element or direct thermal imaging element being substantially light-insensitive, and a support.

The term light-insensitive means that light is not directly involved in the image-forming process, but does not exclude light being indirectly involved such as in the case of light absorption by at least one light-to-heat conversion agent.

The term substantially light-insensitive means not intentionally light sensitive.

The terms "main-scan-speed $v_x$" or "processing speed" are used interchangeably, as well as the terms "slow-scan speed $v_y$" or "transportation speed". The processing direction X and the transportation direction Y are indicated in many drawings (see FIGS. 1, 3, 4, 5 and 8.1).

If, e.g. for commercial reasons, a line-time $t_1$ and a resolution (e.g. dpi) are known, the corresponding slow-scan speeds $v_y$ can be calculated using the expression:

$$v_y = \frac{1}{t_l} \cdot \frac{0.0254}{DPI} \text{ (expressed in m/s)} \quad \text{[eq 1]}$$

Here we assume that the resolution is equal in both directions X and Y, so that symbolically $$DPI_X = DPI_Y = DPI \text{ (expressed in dots/inch)} \quad \text{[eq. 2]}$$

The "sweep-time" $t_s$ (in s) of a flying spot laser system is the time between the beginning of the scanning of one line 40 of pixels ($BOL_j$) and the beginning of the scanning of the same line of pixels ($BOL_{j+1}$). Reference is made to FIG. 8.1, showing three consecutive scanning lines on a thermographic material passing through an internal (stationary) drum ITD, or mounted on e.g. an external (rotating) drum XTD.

If $n_f$ represents the number of faces and $n_p$ the number of revolutions of the polygon mirror (per second), it applies that $$t_s = \frac{1}{n_f \cdot n_p} \text{ (expressed in s)} \quad \text{[eq 3]}$$

For example, some experiments were carried out at $n_f$=8 and $n_p$=1875 (rpm), which results in a $t_s$ of about 4 ms/sweep. Other experiments with the same rotating mirror were carried out at and $n_p$=750 (rpm), which results in a $t_s$ of about 10 ms/sweep. Still other experiments with the same rotating mirror were carried out at and $n_p$=500 (rpm), which results in a $t_s$ of about 15 ms/sweep.

The "total line-time $t_1$" of a flying spot laser system is the time between the beginning of the printing of one line of pixels and the beginning of the printing of the next line of pixels in the printer transport direction Y (often called "slow-scan or sub-scan direction"; and clearly differentiated from a so-called "fast-scan or main-scan direction X").

Since $n_s$ represents the number of sweeps, it follows that $$t_l = n_s \cdot t_s = \frac{n_s}{n_f \cdot n_p} \text{ (expressed in s)} \quad \text{[eq 4]}$$

Equations 3 and 4 have been used for calculating characteristic values for the next table, in preparation of a practical experiment with same the polygon mirror ($n_f$=8) rotating at various speeds (see $n_p$=205 to 2500 rpm).

| | | $n_s$ corresponding to a | | |
|---|---|---|---|---|
| $n_p$ (rpm) | $t_s$ (ms) | $t_l$ of 225 ms | $t_l$ of 630 ms | $t_l$ of 1260 ms |
| | 30.00 | 7.5 | 21 | 42 |
| 250 | 15.00 | 15.0 | 42 | 84 |
| 500 | 10.00 | 22.5 | 63 | 126 |
| 750 | 7.50 | 30.0 | 84 | 168 |
| 1000 | 6.00 | 37.5 | 105 | 210 |
| 1250 | 5.00 | 45.0 | 126 | 252 |
| 1500 | 4.29 | 52.5 | 147 | 294 |
| 1750 | 3.75 | 60.0 | 168 | 336 |
| 2000 | 3.33 | 67.5 | 189 | 378 |
| 2250 | 3.00 | 75.0 | 210 | 420 |

The term "line-width $b_1$" may be self-speaking and is shown (having ref. nr. 44) in FIG. 8.2. Following equation applies:

$$b_l = \frac{25.4}{\text{dpi}} \text{ (expressed in mm)} \quad \text{[eq. 5]}$$

In a later section relating to comparative experiments, the physical origin of a line-width $b_l$ will be explained in reference to FIG. 14.1 showing the geometrical spread 62 of the temperature $T_m$ reached in a first thermographic material when scanned according to a preferred embodiment, and to FIG. 14.2 showing the geometrical spread 63 of the temperature $T_m$ reached in a second substantially light-insensitive thermographic material $m_2$ when scanned with a second preferred embodiment.

The "spatial resolution" means the precision (or separation) with which a picture is reproduced, measured in number of lines that can be distinguished in a picture e.g. expressed in lines/mm, or in dots per inch (dpi). The highest resolution which can be attained by a thermographic system, is here symbolised by $\text{dpi}_{upp}$.

The "pixel-writing time $t_p$" (expressed in s) means the time needed for writing one pixel. Following mathematical relation between pixel-writing time $t_p$ (expressed in s), spatial resolution (expressed in dots per inch DPI) and speed $v_x$ (expressed in m/s) applies:

$$t_p = \frac{1}{dpi \cdot v_X} \text{ [s/dot]} \quad \text{[eq 6]}$$

The term "efficiency η of radiation beam" is defined in relation to a geometrical spread of the available intensity (or power) of the radiation beam (e.g. a Gaussian laser beam as shown in FIG. 13) and comprises the ratio of the (quasi-) total area of such intensity curve to the area of the intensity curve as restricted to temperatures of the substantially light-insensitive thermographic material m being higher than conversion temperature $T_c$. These area can be easily calculated by means of a definite integral calculus.

An "original" is any hard-copy or soft-copy containing information as an image in the form of variations in optical density, transmission, or opacity. Each original is composed of a number of picture elements, so-called "pixels". Further, in the present application, the terms pixel and dot are regarded as equivalent. Furthermore, according to the present invention, the terms pixel and dot may relate to an input image (known as original) as well as to an output image (in soft-copy or in hard-copy, e.g. known as print).

In the present application, a "pixel output $D_o$" or shortly an "output $D_o$" comprises a quantification of a pixel printed on a thermographic material, the quantification possibly relating to characteristics as density (symbolised by D), size, etc.

Some more specific terms will be explained in the following sections.

Thermographic Material

The substantially light-insensitive thermographic material m having a burning temperature $T_b$, used in the present invention, comprises a thermosensitive element having a conversion temperature $T_c$, a support and at least one light-to-heat conversion agent. The substantially light-insensitive thermographic material m may be opaque or transparent. The thickness of the thermosensitive element is generally in the range of about 7 to 25 μm (e.g. 20 μm) and the thickness of the support is generally in the range of about 60 to 180 μm (e.g. 175 μm). Suitable support materials include poly(ethylene terephthalate).

The substantially light-insensitive thermographic material m may further comprise a subbing or substrate layer 66 with a typical thickness of about 0,1 to 1 μm (e.g. 0.2 μm) and/or a protective layer 68 with a typical thickness of about 2 to 6 μm (e.g. 4 μm) on the same side of the support as the thermosensitive element (for numbering see FIG. 17). Optionally, on the other side of the support a backing layer 69 may be provided containing an antistatic and/or a matting agent (or roughening agent, or spacing agent, terms that often are used as synonyms) to prevent sticking and/or to aid transport of the substantially light-insensitive thermographic material m. Further details about the configuration of such substantially light-insensitive thermographic material m are disclosed in EP 0 692 733.

The light-to-heat conversion agents are preferably transparent to visible light and are to be found in the thermosensitive element and/or in an adjacent layer thereto as a solid particle dispersion, a solution or part as solid particles and part as a solution therein. Suitable light-to-heat conversion agents include infrared absorbing dye and absorbers. The light-to-heat conversion agents are preferably homogeneously distributed together or separately in the thermosensitive element, a constituent layer of the thermosensitive element and/or an adjacent layer to the thermosensitive element.

The thermosensitive element contains the ingredients necessary for bringing about the image-forming reaction. The element may comprise a layer system in which the ingredients necessary for bringing about the image-forming reaction may be dispersed in different layers, with the proviso that the ingredients active in the image-forming reaction are in reactive association with one another i.e. during the thermal development process one type of active ingredient must be present in such a way that it can diffuse to the other types of active ingredients so that the image-forming reaction can occur.

Any type of thermosensitive material with different image-forming reactions can be used in the present invention. A preferred thermographic material for use in the present invention is the so-called "laser induced dye transfer LIDT", which is described in U.S. Pat. No. 5,804,355. A preferred image-forming reaction is the reaction of one or more substantially light-insensitive organic silver salts with one or more reducing agents, the reducing agents being present in such a way that they are able to diffuse to the particles of substantially light-insensitive organic silver salt so that reduction to silver can occur.

Preferred substantially light-insensitive organic silver salts for use in the substantially light-insensitive thermographic material used in the present invention are substantially light-insensitive silver salts of an organic carboxylic acid, with substantially light-insensitive silver salts of a fatty acid, such as silver behenate, being particularly preferred.

The so-called "conversion temperature or threshold $T_c$" is defined as being the minimum temperature of the substantially light-insensitive thermographic material m necessary during a certain time range to bring about an image-forming reaction, so as to form visually perceptible image.

If the temperature of the substantially light-insensitive thermographic material increases above $T_c$, the recording density increases further, but generally non-linearly. A substantially light-insensitive thermographic material used according to the present invention generally has a $T_c$ between 75 and 120° C., more specifically between 80 and 110° C.

The "burning temperature $T_b$" of a substantially light-insensitive thermographic material m is the lowest temperature at which any burning might occur, irrespectively in which layer it might happen (e.g. in a support 65, in a substrate layer 66, in a thermosensitive element 67, in a protective layer 68, or/and in a backing layer 69, see FIG. 17 for the numbering).

Apparatus for Thermal Recording of an Image in a Substantially Light-Insensitive Thermographic Material Aspects of the present invention are realized by an apparatus for thermal recording an image in a substantially light-insensitive thermographic material m having a burning temperature $T_b$, the substantially light-insensitive thermographic material m comprising a thermosensitive element having a conversion temperature $T_c$, a support, and at least one light-to-heat conversion agent, comprises a means for generating a radiation beam 20 including wavelengths λ absorbed by the light-to-heat conversion agent and an optical means of scanning a line 40 of the substantially light-insensitive thermographic material m with the radiation beam 20 at different positions thereon along a scanning direction at each point of time in a scanning cycle.

According to a first embodiment of the apparatus, according to the present invention, the radiation beam 20 is capable of being modulated in accordance with the information to be recorded.

According to a second embodiment of the apparatus, according to the present invention, the optical scanning means is capable of heating the line of the substantially light-insensitive thermographic recording material m to a first predetermined temperature $T_1$ being above being above the conversion temperature $T_c$ and below the burning temperature $T_b$ of the substantially light-insensitive thermographic material m.

According to a third embodiment of the apparatus, according to the present invention, the apparatus further comprises a means of cooling the line 40 of the substantially light-insensitive thermographic material m to a second predetermined temperature $T_2$ being below the conversion temperature $T_c$.

According to a fourth embodiment of the apparatus, according to the present invention, the apparatus further comprises a means of re-scanning the line of the substantially light-insensitive thermographic material m a plurality of times $n_s$ with the radiation beam being identically modulated in accordance with the information to be recorded.

Figure 6:
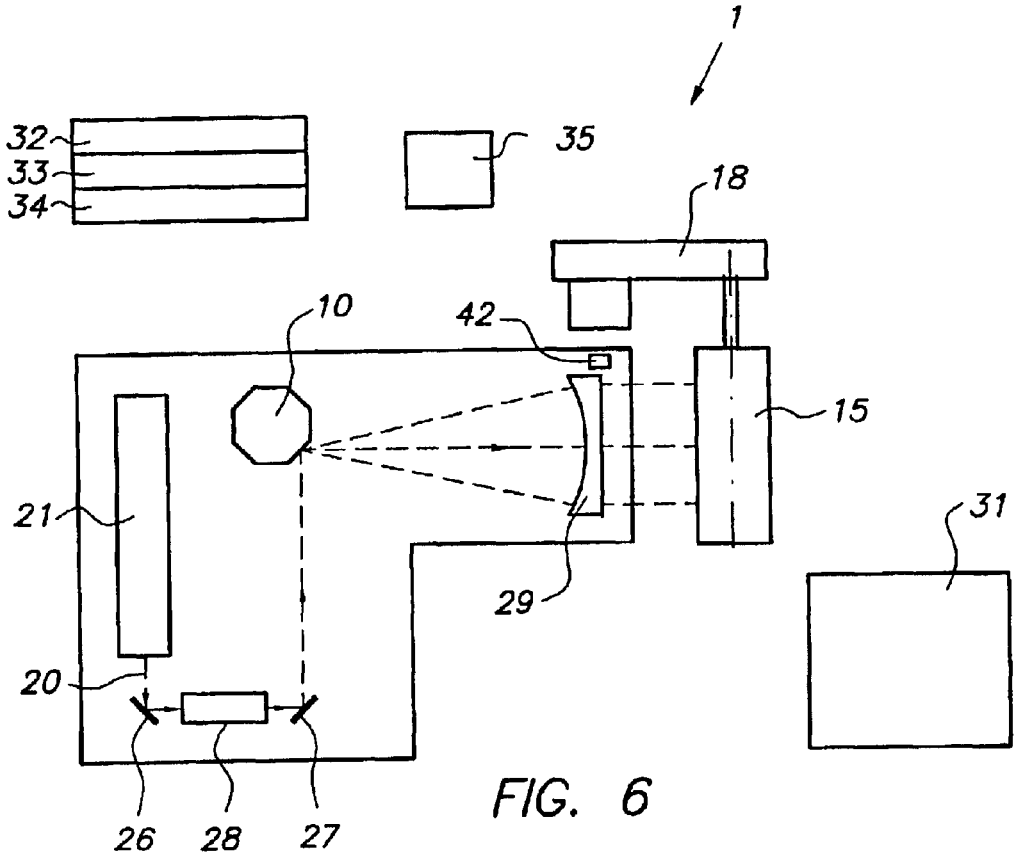
FIG. 6 is a pictorial view of another thermographic system XTD suitable for use according to the present invention.

FIG. 6 is a pictorial view of an apparatus for thermal recording according to the present invention.

According to a fifth embodiment of the apparatus, according to the present invention, the thermographic material is mountable on a holding means 14 (which might be a flat bed), e.g. on an external drum 15.

According to a sixth embodiment of the apparatus, according to the present invention, the thermographic material is mountable on a holding means 14, for example a drum, capable of heating the substantially light-insensitive thermographic material to a preheating temperature $T_p$ below a conversion temperature $T_c$ of the substantially light-insensitive thermographic material.

According to a seventh embodiment of the apparatus, according to the present invention, the means of generating a radiation beam 20 is a laser beam.

According to an eighth embodiment of the apparatus, according to the present invention, the means of generating a radiation beam is a coherent light source (11) comprising a semiconductor- or diode-laser (optionally fibre coupled), a diode-pumped laser (as a neodymium-laser), or an ytterbium fibre laser.

According to a ninth embodiment of the apparatus, according to the present invention, the means of generating a radiation beam 20 is an infrared or near-infrared laser beam i.e. with emission in the wavelength range λ=700–1500 nm. Suitable lasers include a Nd-YAG-laser (neodymium-yttrium-aluminium-garnet; 1064 nm) or a Nd-YLF-laser (neodymium-yttrium-lanthanum-fluoride; 1053 nm). Typical suitable laser diodes emit e.g. at 830 nm or at 860–870 nm.

When a laser scans over the thermographic material, the temperature on the recorded pixels rises and an image-forming process occurs in the thermosensitive element, e.g. reduction of a substantially light-insensitive silver salt of the thermographic material, and a perceptible image appears. After writing a first line, a motor (not shown in drawing FIG. 6) transports the drum one step.

According to a tenth embodiment of the apparatus, according to the present invention, the means of generating a radiation beam 20 is a laser beam (e.g. A YAG-doped ytterbium-laser Yb-YAG emitting a beam of 1030 nm with 20 W power in continuous wave; e.g. type 'DisKlaser' available from the company NANOLASE) which is modulated by a modulator 28, e.g. an acoustic modulator, which can be activated or deactivated.

FIG. 6 shows the laser beam 20 being deflected by a first mirror 26, passing through a modulator 28, e.g. an acoustic modulator, which can be activated or deactivated. When it is activated the laser beam goes to a second mirror 27 and may pass through two lenses to adjust the (vertical) beam-diameter an then comes to moving mirror 10, e.g. a polygon with eight faces. This polygon turns the beam via a fθ objective 29 to a torroidal lens (not explicitly shown) which focuses the beam on the substantially light-insensitive thermographic material.

According to an eleventh embodiment of the apparatus, according to the present invention, the optical scanning means comprises a light deflecting means for deflecting the laser beam to scan the substantially light-insensitive thermographic material m with the deflected laser beam, such as a polygon mirror. The radiation beam scans faster or slower over the substantially light-insensitive thermographic material m, depending upon the speed of the movable components in the optical scanning means, such as a polygon mirror.

According to a twelfth embodiment of the apparatus, according to the present invention, the apparatus further includes a further heating means.

Figure 4:
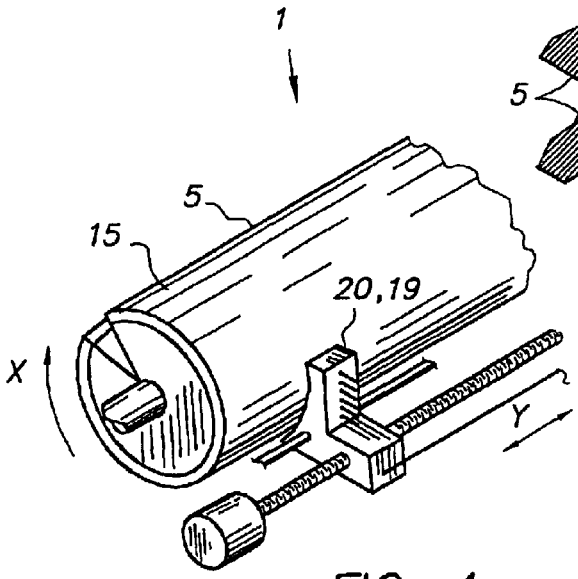
FIG. 4 schematically shows an external drum type recording device suitable for use in a method according to the present invention.

According to a thirteenth embodiment of the apparatus, according to the present invention, the apparatus further includes a further heating means comprising an external drum, such as shown in FIG. 4 and FIG. 8.1 and disclosed in U.S. Pat. No. 5,932,394.

FIG. 4 schematically shows an external drum type recording device having a so called "imaging array" (e.g. a laser-array). In such embodiment, a carriage carrying an array 19 of e.g. laser-diodes, has to move (or to sweep) at least two times from one side (e.g. BOL) of the drum 15 to the other side (e.g. EOL) of the drum. Although this seems to need a longer line-time (because of the mechanical movements of the carriage), it has to be emphasised that such an array preferably scans the substantially light-insensitive thermographic material m (5) with at least two laser beams at a same time (sometimes called "comb-wise"), thus gaining (because of the electro-optical simultaneity) in line-time.

According to a fourteenth embodiment of the apparatus, according to the present invention, the apparatus further includes a further heating means comprising a transparent thermal head (which is not separately shown in FIG. 5), as disclosed in EP-A 1 104 699.

Figure 5:
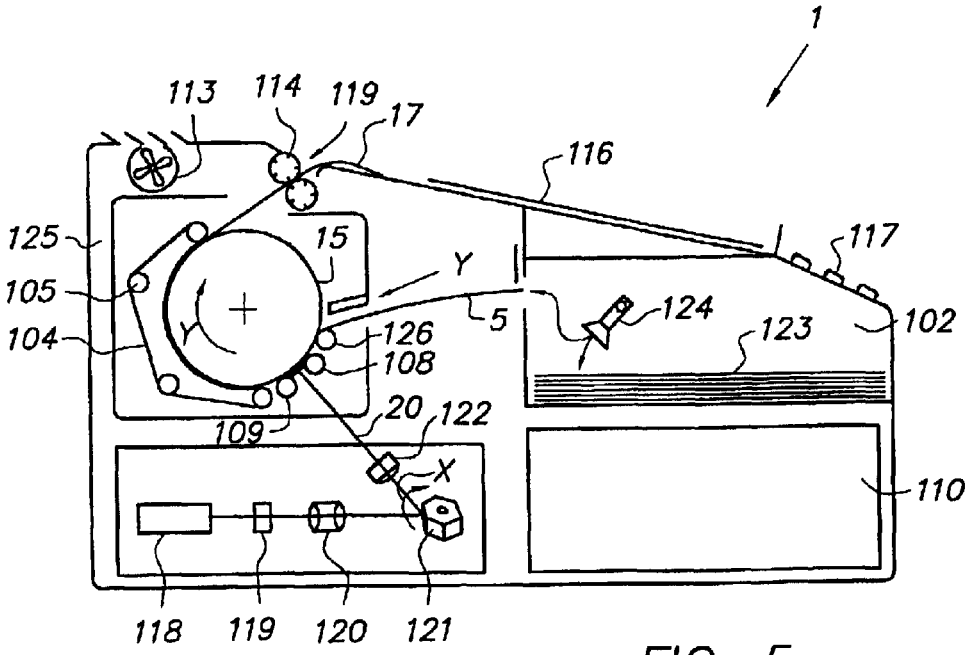
FIG. 5 shows a preferred embodiment of a laser thermographic apparatus suitable for use in a method according to the present invention.

FIG. 5 shows a preferred embodiment of a laser thermographic apparatus suitable for use in a method according to the present invention. In FIG. 5, ref. 5 is the thermal imaging element, 17 a hardcopy print, 20 is a laser beam, 102 a supply magazine, 104 a belt, 105 a tension roller, 108 a roller, 109 a roller, 110 a controller, 113 a ventilator, 116 imaged and processed sheets, 117 a keyboard, 118 a laser source, 119 a modulator, 120 a first objective, 121 a polygon mirror, 122 a second objective, 123 blank sheets to be imaged, 124 a sheet feeder, 125 an imaging and processing unit, 126 a pressure roller. A full description of a laser thermographic printer can be found in DE-A 196 36 253.

According to a fifteenth embodiment of the apparatus, according to the present invention, the apparatus includes controllable parameters comprising 1) specifications of the substantially light-insensitive thermographic material m and the light-to-heat conversion agent, 2) temperature $T_p$ of the drum, 3) position of the thermosensitive element with respect to the drum, 4) power of a laser, 5) input of a modulator 6) transportation speed $v_y$ of the substantially light-insensitive thermographic material m, 7) speed $n_p$ of a rotating optical means, 8) number $n_s$ of sweeps during one line-time $t_1$.

According to a sixteenth embodiment of the apparatus, according to the present invention, the apparatus excludes a transparent thermal head.

Method for Recording Information

Aspects of the present invention are realized by a method for recording information (e.g. imagedata and barcodes), comprising the steps of: providing an apparatus for thermal recording 1, a substantially light-insensitive thermographic material m (5), the thermographic material having a burning temperature $T_b$ (e.g. about 300° C.), and comprising a thermosensitive element having a conversion temperature $T_c$ (e.g. ranging between 80° C. and 110° C., according to the specific type of thermographic material), a support, and at least one light-to-heat conversion agent; generating a radiation beam 20 including wavelengths $\lambda$ absorbed by the light-to-heat conversion agent and being modulated in accordance with the information to be recorded (i.e. imagewise); scanning a line (40 in FIG. 8.1) of the substantially light-insensitive thermographic material m a first time with the radiation beam, thereby heating the line of the substantially light-insensitive thermographic material m to a first predetermined temperature $T_1$ being above the conversion temperature $T_c$ and below the burning temperature $T_b$ of the substantially light-insensitive thermographic material m; re-scanning the same line of the substantially light-insensitive thermographic material m a plurality of times $n_s$ with the radiation beam being identically modulated in accordance with the information to be recorded.

Figure 7:
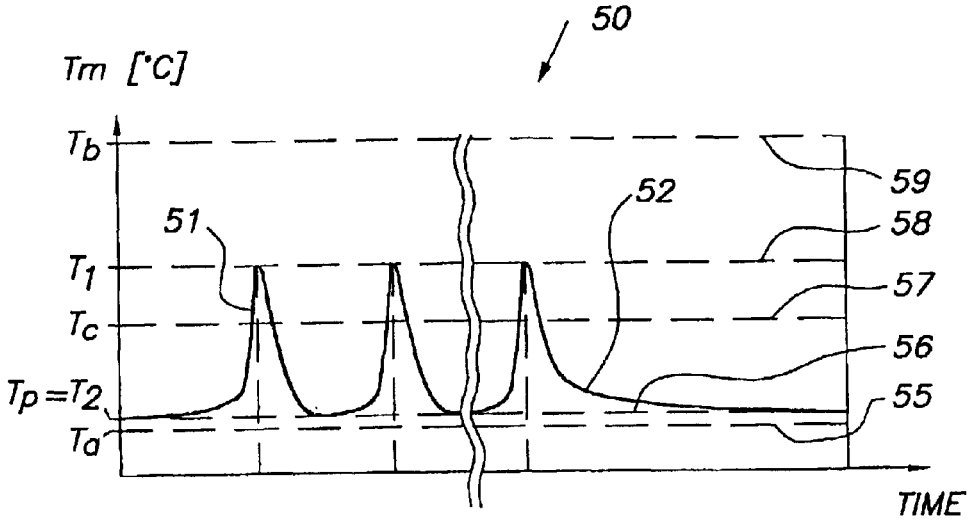
FIG. 7 principally shows the evolution over time of the temperature reached in a thermographic material while applying a plurality of scannings according to the present invention.

FIG. 7 shows the evolution over time of the temperature attained in a thermographic material while applying a plurality of scannings according to the present invention).

Figure 11:
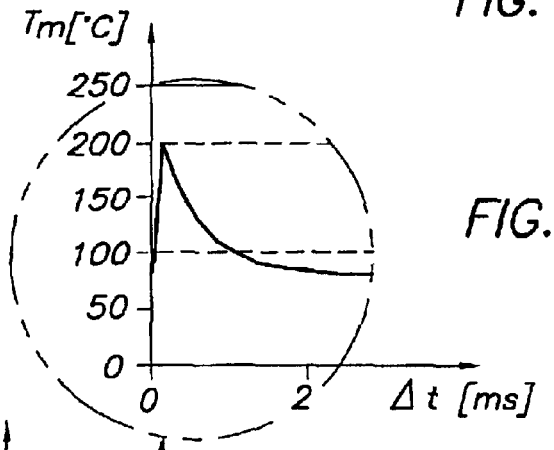
FIG. 11 shows a practical evolution over time of the temperature $T_m$ in the thermosensitive element if an information is recorded in one single sweep.
Figure 12:
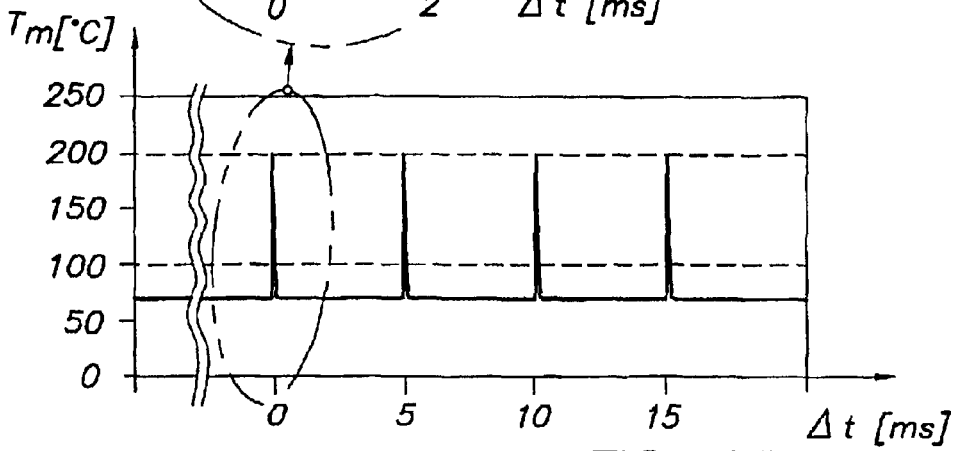
FIG. 12 shows a practical evolution over time of the temperature reached in the thermosensitive element if an information is recorded by applying a plurality of scannings according to the present invention.

In FIGS. 11 and 12 several experiments are shown in which the first predetermined temperature $T_1$ was about 200° C.

According to a first embodiment of the method, according to the present invention, the method further comprises cooling the line 40 of the substantially light-insensitive thermographic material m to a second predetermined temperature $T_2$ being below the conversion temperature $T_c$, with non-forced cooling, i.e. natural, physical decay of the temperature over time, being preferred. Examples of forced cooling is cooling with a blower.

In general, the second predetermined temperature $T_2$ is between the conversion temperature $T_c$ and the ambient temperature $T_a$. In a preferred embodiment, the second predetermined temperature $T_2$ is nearly at ambient temperature $T_a$. In another preferred embodiment, wherein a substantially light-insensitive thermographic material m is in contact with a holding means 14 (e.g. being flat as shown in FIG. 1, or e.g. being cylindrical as shown by a drum 15 in FIGS. 3–6, and 8.1) the second predetermined temperature $T_2$ is at the so-called preheating temperature $T_p$, so that $T_2=T_p$ (see FIG. 7). In those embodiments wherein the holding means 14 or the drum 15 is not preheated, the temperature $T_p$ is ambient temperature $T_a$ (so that $T_2=T_p=T_a$).

According to a second embodiment of the method, according to the present invention, the method further comprises the removal of the substantially light-insensitive thermographic material m from the apparatus for thermal recording 1, thereby delivering a hard-copy print (indicated by ref. nr. 17 in FIG. 5) of the information.

According to a third embodiment of the method, according to the present invention, an upper limit of spatial resolution ($dpi_{upp}$) is controlled by determining a main-scan-speed $v_y$ in relation to the first predetermined temperature $T_1$.

For example, if, for a given substantially light-insensitive thermographic material m and for a given predetermined temperature $T_1$, it is desired to increase a spatial resolution in a hard-copy print 17 up to a required value $dpi_{upp}$, the main-scan-speed $v_x$ might be increased.

The speed of the radiation beam over the substantially light-insensitive thermographic material increases with increasing speed of the rotating polygon. By virtue of the normally non-square distribution of the intensity of the laser beam (see FIG. 13), only a part of the thermographic material irradiated attains a temperature higher than the conversion temperature $T_c$ (see FIGS. 14.1 and 14.2). Hence, at a higher main-scan-speed $v_x$ smaller lines will be recorded. If the slow-scan-speed $v_y$ is also increased correspondingly, a higher spatial resolution is attained, i.e. $dpi_{upp}$.

Since at a higher main-scan-speed $v_x$ a decreased efficiency $\eta$ of the laser system is observed (see e.g. FIG. 15, to be explained below), it may be necessary to increase the number of sweeps $n_s$ in order to obtain a density which is sufficiently high.

According to a fourth embodiment of the method, according to the present invention, the method further comprises a step of controlling a spatial resolution (dpi) of the hardcopy print 17 by choosing the first temperature $T_1$ substantially higher than $T_c$.

In certain circumstances, the first temperature $T_1$ is relatively close to the $T_c$ (as shown in FIG. 14.1 for a thermographic material scanned at a rather high main-scan-speed $v_x$), which results in thinner lines be obtained.

In other preferred circumstances, the first temperature $T_1$ is relatively far away from the $T_c$ (as shown in FIG. 14.2 for a same thermographic material scanned at a rather low main-scan-speed $v_x$), which results in thicker lines being obtained.

If it is desired to increase the spatial resolution (dpi) in a hard-copy print 17, e.g. up to the upper limit $dpi_{upp}$ for a given substantially light-insensitive thermographic material m and for a given main-scan-speed $v_x$, the first temperature $T_1$ should be decreased.

FIGS. 14.1 and 14.2 also illustrate another embodiment of the present invention. For a same upper limit of the temperature $T_m$, the spatial resolution (dpi) of the hardcopy print 17 can be controlled by selecting the type of thermographic material, especially with respect to the conversion temperature $T_c$ e.g. if an apparatus were to comprise two or more film cassettes comprising at least two kinds of thermographic materials, say $m_1$ and $m_2$ having respective conversion temperatures $T_{c1}$ and $T_{c2}$.

In general, FIG. 14.1 shows the geometrical spread 62 of the temperature $T_m$ reached in a thermographic material when scanned according to a preferred embodiment, and FIG. 14.2 shows the geometrical spread 63 of the temperature $T_m$ reached in a thermographic material when scanned according to a second preferred embodiment.

More in detail, from one point of view, FIG. 14.1 shows the geometrical spread of the temperature $T_m$ reached in a thermographic material when scanned with a high speed laser beam; and FIG. 14.2 shows the geometrical spread of the temperature $T_m$ reached in a thermographic material when scanned with a low speed laser beam. From another point of view, FIG. 14.1 shows the geometrical spread of the temperature $T_m$ reached in a first substantially light-insensitive thermographic material $m_1$ when scanned with a laser beam; and FIG. 14.2 shows the geometrical spread of the temperature $T_m$ reached in a second substantially light-insensitive thermographic material $m_2$ when scanned with a same laser beam.

It may be quite clear that in a method according to the present invention the burning temperature $T_b$ is not to be exceeded (see FIGS. 7, 11 and 12).

FIG. 11 shows the actual evolution over time of the temperature $T_m$ in the thermosensitive element if an information is recorded in one single sweep and FIG. 12 shows the actual evolution over time of the temperature $T_m$ attained in the thermosensitive element if an information is recorded by applying a plurality of scannings according to the method of the present invention. Applying a plurality of scannings eliminates unwanted side-effects such as deformation, colouring and burning.

Figure 10:
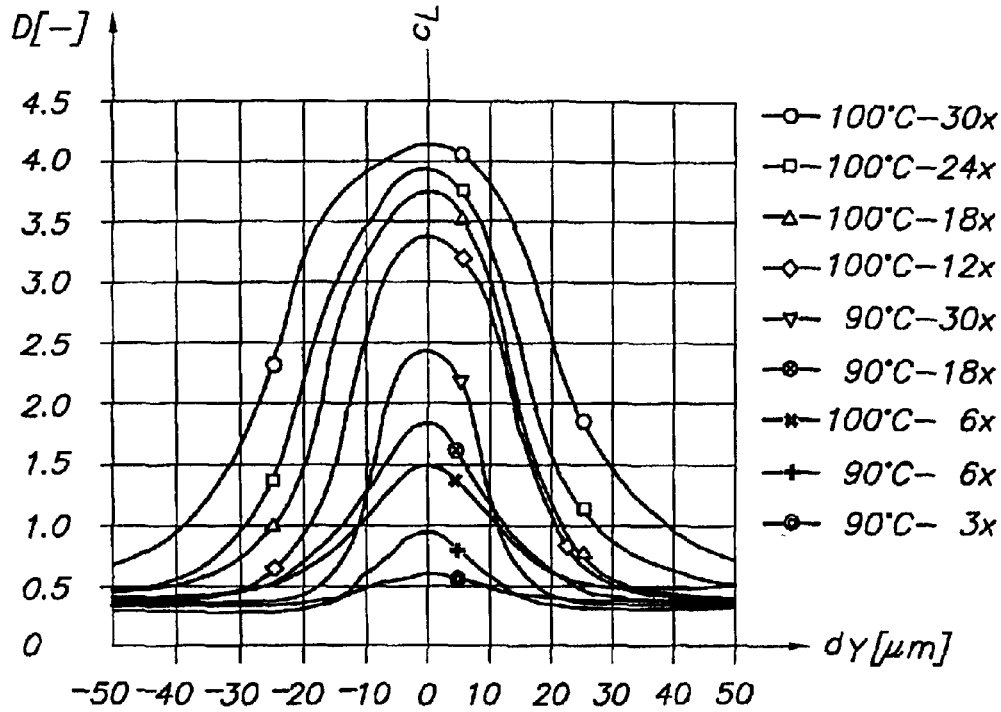
FIG. 10 shows an output density on a thermographic material, in function of (i) a pixel-distance $d_y$ to the central axis of a printed line, (ii) a preheating temperature $T_p$ and (iii) a number of sweeps $n_s$.

According to a fifth embodiment of the method, according to the present invention, the plurality of times $n_s$ comprises at least two times ($n_s \geqq 2$; see also FIGS. 7, 10 and 12).

According to a sixth embodiment of the method, according to the present invention, the plurality of times $n_s$ is defined such that a desired pixel output ($D_o$) is achieved.

In certain circumstances, the first temperature $T_1$ is relatively close to $T_c$ (as shown in FIG. 14.1), which results in thinner lines being attained such that more sweeps have to be performed in order to attain a sufficient density in the output print 17 (especially in the mid of the line width 44, see FIGS. 8.2, 10, 14.1 and 14.2).

In other preferred circumstances, the first temperature $T_1$ is relatively distant to the $T_c$ (as shown in FIG. 14.2), thereby obtaining thicker lines and generally requiring less sweeps.

According to a seventh embodiment of the method, according to the present invention, an upper limit of spatial resolution ($dpi_{upp}$) is controlled by determining an energy radiated by the radiation beam in relation to a main-scan-speed $v_x$.

The laser output is required to produce a sufficient energy to enable a desired density to be obtained with the substantially light-insensitive thermographic material m. When a laser scans over the thermographic material, the temperature on the recorded pixels rises, the imaging-forming reaction occurs and a perceptible image appears. After writing a first line, a motor (not shown in drawing FIG. 6) transports the drum one step.

According to an eighth embodiment of the method, according to the present invention, the method further comprises a step of defining a position (wherein the scanning of the substantially light-insensitive thermographic material m is carried out) of the thermosensitive element with respect to a holding means 14 or a drum 15. We refer to FIGS. 18.1 and 18.2 respectively showing a thermographic system incorporating a first and a second position (REPL versus RPEL) of the thermosensitive element with respect to a holding means 14, or a drum 15.

According to a ninth embodiment of the method, according to the present invention, the method further comprises a step of further heating (also called "background heating or preheating") the substantially light-insensitive thermographic material m to a preheating temperature $T_p$ before and/or during scanning thereof with the radiation beam (see FIGS. 5 and 7).

FIG. 17 (not shown to scale) shows a cross-section of a configuration of a substantially light-insensitive thermographic material m suitable for application within the present invention.

According to a tenth embodiment of the method, according to the present invention, the substantially light-insensitive thermographic material m comprises a thermosensitive element consisting of at least one layer, the thermosensitive element comprising a substantially light-insensitive organic silver salt and a reducing agent therefor in thermal relationship therewith, the reducing agent being in a layer of said thermosensitive element containing said substantially light-insensitive organic silver salt and/or in an adjacent layer of the thermosensitive element such that the reducing agent is present such that it is in thermal working relationship with said substantially light-insensitive organic silver salt.

According to an eleventh embodiment of the method, according to the present invention, the method further comprises a step of further heating the substantially light-insensitive thermographic material m with a transparent thermal head.

Furthermore, in addition to Gaussian and non-Gaussian beam intensities, it may be advantageous to shape the writing spot such that it becomes a "top-hat" writing spot. This may be carried out e.g. by so-called diffractive optical elements (DOE).

According to a twelfth embodiment of the method, according to the present invention, the substantially light-insensitive thermographic material excludes an image-forming layer on a hydrophilic surface.

INDUSTRIAL APPLICATION

The apparatus for thermal recording an image, according to the present invention, is used for recording information in substantially light-insensitive thermographic materials for medical and graphics applications.

EXAMPLES

All experiments were carried out on an XTD-embodiment as shown in FIG. 6. Practical dimensions of this system (see also FIG. 8.1) included: the diameter $D_d$ of drum 15 being 70 mm, the width of the drum 15 being 250 mm and the width $W_m$ (46) of the thermographic material being 200 mm.

A preferred embodiment of the present invention was tested and evaluated extensively. The controllable parameters mentioned above, are summarized in the following paragraph.

1) Thermographic specifications of the substantially light-insensitive thermographic material m and of the IR-absorber (e.g. spectral bandwidth and sensitivity) were selected from a matrix of available values.
2) The temperature $T_p$ of the drum 15 was controlled in a range between 30° C. and 150° C., more preferably between 50° C. and 120° C., and set most typically at discrete values of 70, 75, 80, 85, 90 and 100° C.
3) As regards the position of the thermographic material 5 with respect to the drum 15, the influences of two possibilities (mentioned as REPL versus RPEL in FIGS. 18.1 and 18.2) were explored.
4) The radiation source 21 was a YAG doped Yb-laser having a wavelength λ of 1030 nm. An available power of 20 Watt (in continuous wave mode) resulted in about 9 Watt impacting on the thermographic material 5. Sometimes lower values for the power have been chosen by reducing the power supply (e.g. a control current of 45 A corresponded to a power of 20 W).
5) The input $V_{c,m}$ of a modulator 28, more specifically the voltage supply to an acousto-optic-modulator AOM (in particular, an AOM as e.g. type 1110AF_AIFO_2 supplied by CRYSTAL TECHNOLOGY CORPORATION, was generally set at 1 Volt, which gave an output $P_{o,m}$ of about 93% (see also FIG. 9 showing a relation between a control voltage $V_{c,m}$ to an acousto-optical modulator and the percentage of transmitted laser power $P_{o,m}$).
6) The transportation or slow-scan-speed $v_y$ of the substantially light-insensitive thermographic material m ranged between 0.35 and 4.5 mm/s. Particularly tested speeds included 0.35, 0.42, 0.52, 0.70, 1.05, 1.25 and 2.00 mm/s.
7) The speed $n_p$ of the rotating optical means (e.g. a mirror or a polygon) ranged between 250 and 3500 rpm. Particularly tested speeds included 444, 500, 750 and 1875 rpm.
8) The number $n_s$ of sweeps (during a line-time $t_1$) $n_s$ ranged from 1 time to 400 times. Particularly tested values included 3, 6, 12, 18, 24, 30, 42, 50, 63, 100, 200 and 400 sweeps.

It should be noted that the line-time $t_1$ can be derived from the sweep-time $t_s$ (cf. $n_p$ and equation 4) and from the number $n_s$ of sweeps. The $t_1$ values tested included 20, 30, 40, 50, 60, . . . 225, 630, to 1260 ms.

Extensive experimentation was carried out during the test programme leading to the present invention. For sake of brevity, two sets of experiments are described below in detail to illustrate the invention more clearly.

FIG. 10 records the results of the first set of experiments and shows an output density (e.g. ranging up to 4.5 D) for a substantially light-insensitive thermographic material m, as a function of:

(i) a pixel-distance $d_y$ (e.g. ranging from −50 μm to +50 μm) to the central axis $C_L$ of a printed line 40 (see also FIG. 8.2),
(ii) a background heating or preheating temperature $T_p$ (e.g. 90° C. or 100° C.), and
(iii) a number of sweeps $n_s$ (e.g. ranging from 3 times to 30 times.

From these experiments it can be concluded that:

i) more sweeps result in a higher density; more sweeps result in a broader line-width;
ii) for a background temperature $T_p$=90° C., at least 30 sweeps are necessary in order to attain an acceptable density;
iii) for a background temperature $T_p$=100° C., at least 12 sweeps are necessary in order to attain an acceptable density;
iv) a higher background temperature makes it possible to record faster, but the resolution of the output image decreases; and
v) by recording according to the present invention, a density D>4.0 is attainable without losing tone neutrality.

Figure 15:
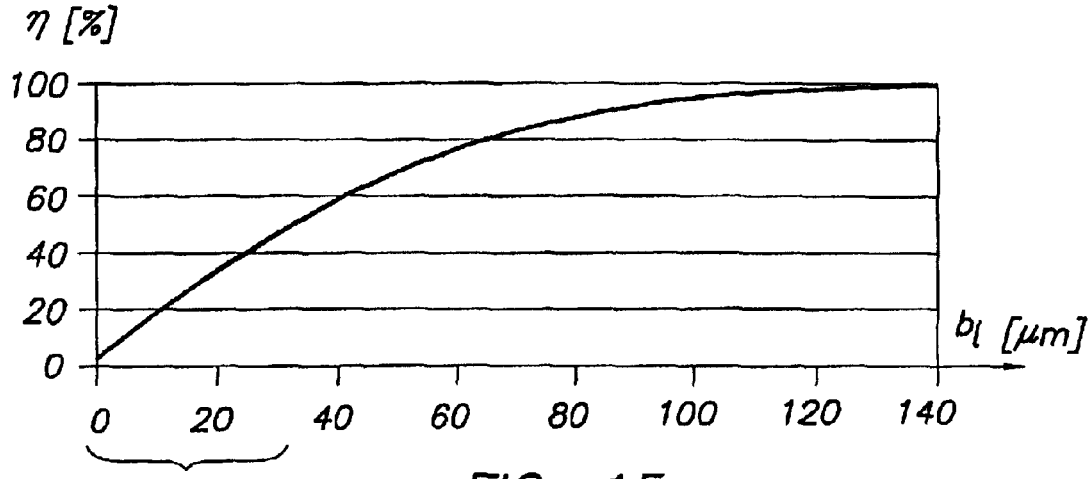
FIG. 15 shows the efficiency η of a laser system when different line-thicknesses are applied.
Figure 16:
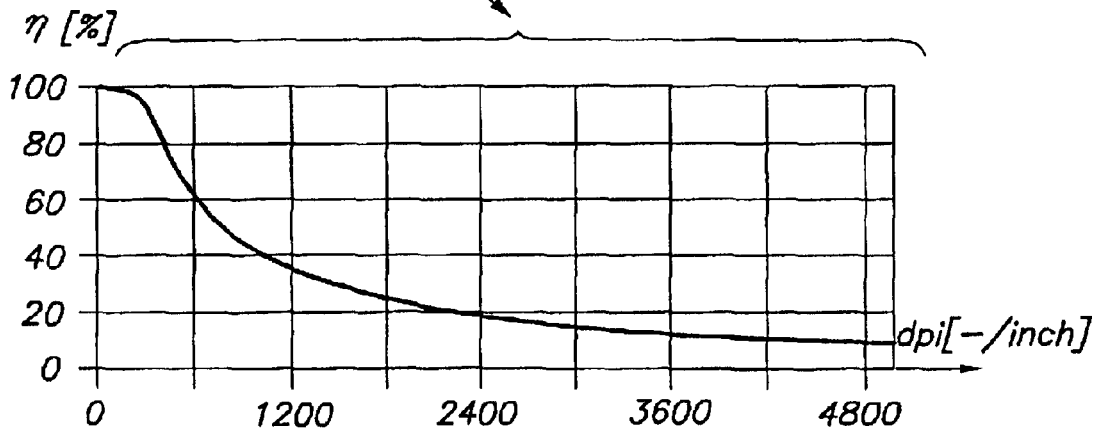
FIG. 16 shows the efficiency η of a laser system when different spatial resolutions are applied.

FIGS. 15 and 16 record the results of the second set of experiments, which confirmed: (i) that a higher speed of revolution of the polygon normally resulted in a smaller line-width and hence in a higher spatial resolution, but also (ii) that a higher speed of rotation of the polygon resulted in a lower efficiency η of the thermographic system. Given a particular system and a particular substantially light-insensitive thermographic material m, our tests concerning spatial resolution resulted in FIG. 15 showing the efficiency η of the laser system when different line-thicknesses were applied, and in FIG. 16 showing the efficiency η of the laser system when different spatial resolutions were applied.

For ensure that the term "efficiency η of radiation beam" is well understood, FIG. 14.1 is referred to in which the geometrical spread of the temperature attained in a first substantially light-insensitive thermographic material ml when scanned with a Gaussian laser beam, and to FIG. 14.2 showing the geometrical spread of the temperature reached in a second substantially light-insensitive thermographic material $m_2$ when scanned with a same Gaussian laser beam. It may be noted that according to the present invention, high spatial resolutions e.g. higher than 600 or even 1200 dpi or small line-widths e.g. smaller than 40 or even 20 μm are attained.

Having described in detail preferred embodiments of the current invention, it will now be apparent to those skilled in the art that numerous modifications can be made therein without departing from the scope of the invention as defined in the appending claims.

I claim:

1. A method for recording information, comprising the steps of:

providing an apparatus for thermal recording, a substantially light-insensitive thermographic material m, said thermographic material having a burning temperature $T_b$, and comprising a thermosensitive element having a conversion temperature $T_c$, a support, and at least one light-to-heat conversion agent;

generating a radiation beam including wavelengths λ absorbed by said light-to-heat conversion a nt and being modulated in accordance with said information to be recorded;

scanning a line of said substantially light-insensitive thermographic material m a first time with said radiation beam, thereby heating said line of said substantially light-insensitive thermographic material m to a first predetermined temperature $T_1$ being above said conversion temperature $T_c$ and below said burning temperature $T_b$ of said substantially light-insensitive thermographic material m; and re-scanning said same line of said substantially light-insensitive thermographic material m a plurality of times $n_s$ with said radiation beam being identically modulated in accordance with said information to be recorded.

2. Method according to claim 1, wherein the method further comprises cooling said line of said substantially light-insensitive thermographic material m to a second predetermine temperature $T_2$ being below said conversion temperature $T_c$.

3. Method according to claim 1, wherein an upper limit of spatial resolution ($dpi_{upp}$) is controlled by determining a main-scan-speed $v_x$ in relation to said first predetermine temperature $T_1$.

4. Method according to claim 1, wherein said plurality of times $n_s$ comprises at ast two times ($n_s$>2).

5. Method according to claim 4, wherein said plurality of times $n_s$ is defined such at a desired pixel output ($D_o$) is achieved.

6. Method according to claim 1, wherein an upper limit of spatial resolution is controlled by determining an energy radiated by said radiation beam in relation to a main-scan-speed $v_x$.

7. Method according to claim 1, comprising a step of further heating the substantially light-insensitive thermographic material m to a preheating temperature $T_p$ before and/or during scanning thereof with the radiation beam.

8. Method according to claim 1, comprising a step of defining a position of the thermosensitive element with respect to a holding means or a drum.

9. Method according to claim 1, wherein said substantially light-insensitive thermographic material m comprises a thermosensitive element consisting of at least one layer, said thermosensitive element comprising a substantially light-insensitive organic silver salt and a reducing agent therefor in thermal relationship therewith, said reducing agent being in a layer of said thermosensitive element containing said substantially light-insensitive organic silver salt and/or in an adjacent layer of said thermosensitive element such that said reducing agent is present such that it is in thermal working relationship with said substantially light-insensitive organic silver salt.

10. An apparatus for thermal recording an image in a substantially light-insensitive thermographic material m having a burning temperature $T_b$, said substantially light-insensitive thermographic material m comprising a thermosensitive element having a conversion temperature $T_c$, a support, and at least one light-to-heat conversion agent, comprises a means for generating a radiation beam including wavelengths λ absorbed by said light-to-heat conversion agent;

an optical means of scanning a line of said substantially light-insensitive thermographic material m with said radiation beam at different positions thereon along a scanning direction at each point of time in a scanning cycle and a means of re-scanning the line of the substantially light-insensitive thermographic material m a plurality of times ns with the radiation beam being identically modulated in accordance with the information to be recorded.

11. Apparatus according to claim 10, further comprising an additional heating means.

12. A process for using a method for recording information, comprising the steps of:

providing an apparatus for thermal recording, a substantially light-insensitive thermographic material m, said thermographic material having a burning temperature $T_b$, and comprising a thermosensitive element having a conversion temperature $T_c$, a support, and at least one light-to-heat conversion agent;

generating a radiation beam including wavelengths λ absorbed by said light-to-heat conversion agent and being modulated in accordance with said information to be recorded;

scanning a line of said substantially light-insensitive thermographic material m a first time with said radiation beam, thereby heating said line of said substantially light-insensitive thermographic material m to a first predetermined temperature $T_1$ being above said conversion temperature $T_c$ and below said burning temperature $T_b$ of said substantially light-insensitive thermographic material m; and re-scanning said same line of said substantially light-insensitive thermographic material m a plurality of times $n_s$ with said radiation beam being identically modulated in accordance with said information to be recorded;

in laser thermography.

* * * * *